United States Patent [19]

Howe

[11] 3,949,216

[45] Apr. 6, 1976

[54] LIGHT DISPERSING STRUCTURE FOR ELECTRIC LIGHT FIXTURE

[76] Inventor: Arnold P. Howe, 2 Saroni Court, Oakland, Calif. 94611

[22] Filed: Aug. 13, 1973

[21] Appl. No.: 387,690

Related U.S. Application Data

[63] Continuation-in-part of Ser. No. 290,896, Sept. 21, 1972, abandoned.

[52] U.S. Cl. .... 240/51.11 R; 240/81 R; 240/81 LD

[51] Int. Cl.[2] ..... H05B 33/02

[58] Field of Search ..... 240/3, 11.2, 27, 51.61, 240/52, 81, 81 A, 81 LD, 84, 1.2, 22

[56] References Cited

UNITED STATES PATENTS

| | | | |
|---|---|---|---|
| 2,336,750 | 12/1943 | Roney et al. | 240/51.11 R X |
| 2,586,374 | 2/1952 | Pennow | 240/1.2 |
| 2,645,709 | 7/1953 | Thorstensen | 240/81 R X |
| 2,907,868 | 10/1959 | Henschel | 240/1.2 |
| 3,230,360 | 1/1966 | Short | 240/81 R X |
| 3,237,005 | 2/1966 | Norton | 240/11.2 |
| 3,244,868 | 4/1966 | Goetz | 240/81 R X |
| 3,249,749 | 5/1966 | Haas | 240/51.11 R X |

*Primary Examiner*—R. M. Sheer
*Attorney, Agent, or Firm*—Warren, Chickering & Grunewald

[57] ABSTRACT

There is disclosed an electric light fixture for an elongated light source such as a fluorescent tube which includes 1) a base containing the necessary electrical components, 2) a light-transmitting support, held by the base, which supports the upper end of the elongated light source as well as the upper structure of the fixture and which carries electric conductors held close to the light source, and 3) a light-diffusing structure completely surrounding and spaced from the support.

8 Claims, 8 Drawing Figures

LIGHT DISPERSING STRUCTURE FOR ELECTRIC LIGHT FIXTURE

This application is a continuation-in-part application of my patent application for SUPPORT COLUMN AND ASSEMBLY FOR VERTICAL ELECTRIC LIGHT FIXTURE, Ser. No. 290,896, filed Sept. 21, 1972 now abandoned.

This invention relates to lighting fixtures and more specifically to lamps, especially those of the so-called free-standing type, both indoor and outdoor including devices which may simply rest on the ground; to hanging lamps nowadays somtimes referred to as "swag lights"; to pole lamps; to pedestal mounted fixtures; and to portable battery operated lanterns. While my invention will be seen to have general application to most any type of lamp fixture employing an elongate light source tube, it is particularly applicable to fixtures employing conventional fluorescent tube elements.

A vexing problem that has long plagued the lighting industry in connection with elongate light source tubes, hereafter referred to merely as light tubes (fluorescent, incandescent, sodium vapor, halogen, inert ionized gases, such as neon, and the like) is that when mounted for operation the supporting fixture normally necessary to carry the light tube and provide electrical connections obstructs fully half of the tube's illumination. This is more or less tolerable in the case of wall fixtures and certain common desk lamps, but is a detriment where it is desired to obtain maximum illumination, i.e., 360° about the elongate light source, as is especially the case in lamps of the type enumerated above, e.g., free-standing, hanging, pole type, and pedestal mounted lamps.

In the prior art with which I am familiar, little if any effort appears to have been directed to the problem of 360° illumination about a light tube source, particularly a single light tube, although vertical light tube assemblies in connection with portable and portable safety lamps are well known—see for example U.S. Pat. Nos. 2,336,750; 2,874,270; and 3,249,749. Vertical ornamental light assemblies have been considered—see for example U.S. Pat. Nos. 2,645,709; 3,230,360; 3,086,106; 3,521,047; 3,207,893; and 3,141,620.

None of the aforementioned references, however, is directed to, nor suggests, the solution to the problem of 360° illumination, with the possible exception of the U.S. Pat. No. 3,141,620 to K. F. Guggemos; but Guggemos, to the extent that that disclosure attempts to provide ". . . good light distribution . . . laterally in all directions therefrom," relies upon a multiple tube arrangement and structure which itself is light obstructing in respect of any single one of the vertical light tube sources employed therein.

The lighting device of the U.S. Pat. No. 3,230,360 to H. V. Short embodies embedded conductors with fluorescent tube as the light source. However, the Short patent does not have as its purpose the achievement of a shadow-free 360° illumination around the tube but rather is directed to a decorative portable lighting device. The problem of eliminating variations in light intensity about the tube is nowhere addressed in the Short disclosure. Even with the elimination of Short's reflective strip 8, his fixture would show sharp shadows from the embedded conductors, such shadows being aesthetically objectionable in the usage of light fixtures of the type with which I am concerned.

Likewise, the U.S. Pat. No. 2,645,709 to M. C. Thorstensen, is directed toward ornamental illumination and particularly to novel color effects in lighting fixtures. This reference discloses a transparent casing to surround a fluorescent light source. Such a light fixture utilizes opaque reflectors to produce novel color effects and a plurality of shadow-producing support and guide rods. Such structure is inimical to the attainment of a uniform shadow-free illumination in accordance with the instant invention.

Thus it is an object of the present invention to provide an improved light dispersing structure for use with an elongate light tube source which enhances shadow-free, uniform 360° illumination thereabout and that may be employed in an electric light fixture of the type utilizing a lamp base to house the light switch circuitry and carry the improved light dispersing structure.

As used throughout the specification and claims herein, the term "lamp base" refers not only to the lowermost portion of a lamp assembly as may be employed in so-called upright table lamps and the like, but also to that portion of hanging fixtures, pole lamps, and horizontally disposed fixtures which support, carry, or are otherwise structurally interconnected to the light dispersing structure embraced by the instant invention.

A feature and an advantage of the present invention is that it may be beneficially applied to a highly efficient use of fluorescent light tubes, and enhance the application of this desirable type of soft light source to a wide variety of lamp fixtures, e.g. table lamps, pole lamps, hanging lamps, and pedestal mounted fixtures, heretofore largely impracticable for this type of lighting element.

Still further objects, features, and advantages will become apparant to one of ordinary skill in the art upon a reading of the specification which follows and with reference to the accompanying drawings.

Turning now to the drawings.

Figure 1:
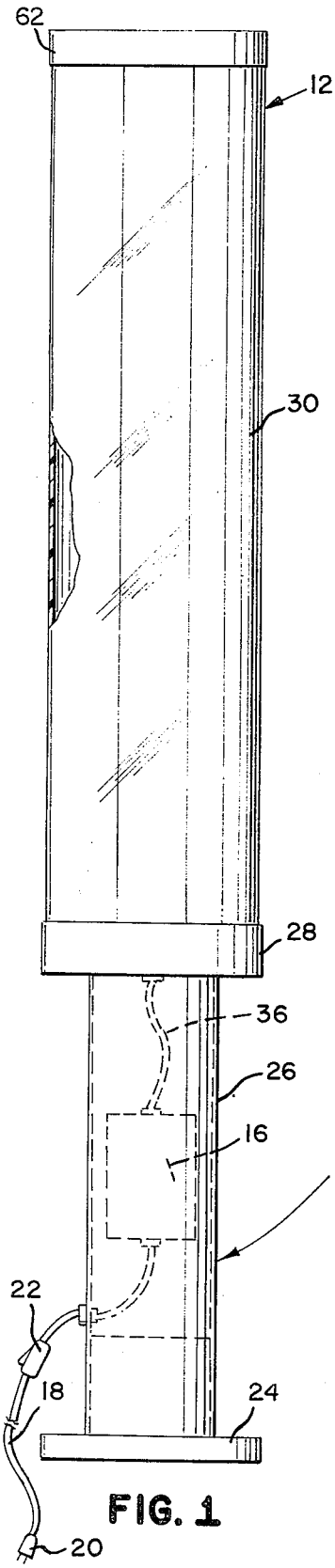
FIG. 1 is a side elevation of one type of lighting fixture embracing my invention with a small portion thereof fragmented to clarify certain details.
Figure 2:
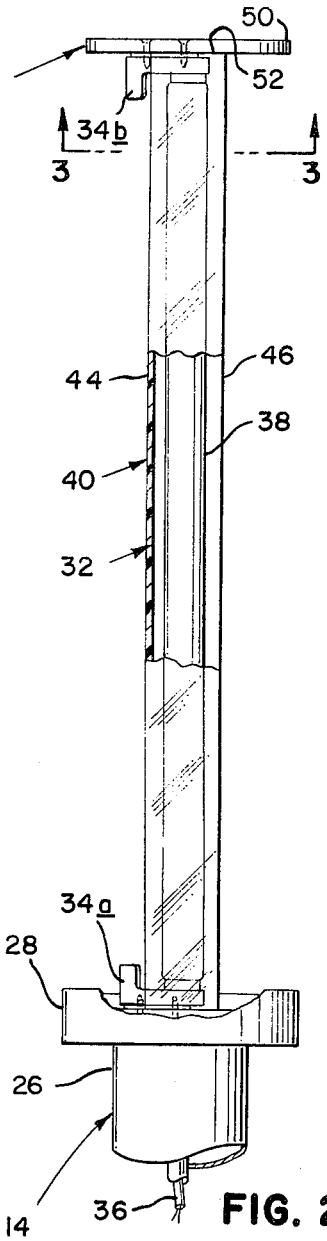
FIG. 2 is a side elevation of the same device as that illustrated in FIG. 1, except one entire outer light dispersing fixture has been removed to reveal certain details within, and certain portions are shown fragmented or removed for sake of clarity.

Turning first to FIGS. 1 and 2 I show a free-standing light fixture 12 of the type employing lamp base 14 to house ancillary light circuitry 16. In the particular embodiment shown such circuitry is generally indicated and is intended to represent a fluorescent light starter/-ballast obtaining power from a conventional source (not shown) through electrical conductor cord 18 having at one end thereof typical male plug 20 and intervening on/off switch 22. Lamp base 14 itself comprises pedestal 24, cooperatively engaging housing shell 26, and upper flange 28 which forms the contacting receptacle upon which rests outer light dispersing fixture 30, inner supporting member 32, and lower light tube socket 34*a* which is electrically connected by means of wire assembly 36 to circuit 16.

For aesthetic purposes, particularly with respect to table lamps, pedestal 24 could be deepened so as to house the light circuitry 16 within, connecting the pedestal to flange 28 via a decorative hollow assembly carrying the necessary electrical wiring and replacing housing shell 26.

With greater attention now directed to inner supporting member 32 (FIG. 2) one may appreciate how I attain the objective of my invention to provide an improved light dispersing structure which enhances shadow-free, uniform 360° illumination about an elongate light tube source, such as fluorescent tube 38 shown mounted therein. More specifically inner supporting member 32 comprises channel member 40 fabricated of a relatively thin light transmitting sheet material (translucent or transparent), preferably selected from the group of substances consisting of acrylics, allylics, nylons, polyacetals, polycarbonates, polyesters, polystyrenes and other suitable plastic materials, or those glasses or translucent ceramics which are structurally strong enough to perform the supportive functions of member 32 as explained herein.

Channel walls 42, 44, 46 are fabricated substantially free of any light-obstructing material or additional elements secured thereto, and in cross-sectional configuration (FIG. 4B) provide an open side having opening dimension 48 to removably receive therethrough fluorescent tube 38. Moreover, channel 40 is adapted to carry at each end thereof light tube sockets 34*a*, 34*b*. In the particular embodiment shown, lower socket 34*a* is threadedly secured by means of conventional fasteners to the inner surface of flange 28 and faces up into channel 40 which in turn is secured to bosses provided within the same flange; and upper socket 34*b* is threadedly fastened to plate member or disc 50 which in turn may be removably secured by conventional means to uppermost edge surface 52 of channel 40. Light tube sockets 34*a* and 34*b* provide physical and electrical securement of light tube 38.

Figure 3:
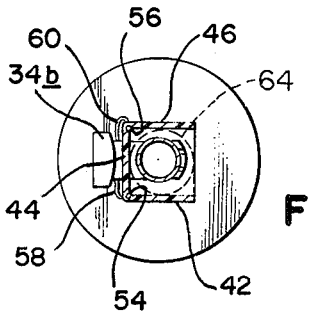
FIG. 3 is a sectional view taken along line 3—3 of FIG. 2 wherein an auxiliary light dispersing fixture is additionally shown in phantom.
Figure 4A:
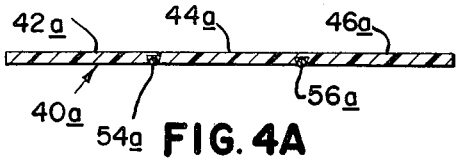
FIG. 4A is a sectional view of a portion of the assembly embodying my invention showing such portion during one possible way by which it could be fabricated.
Figure 4B:
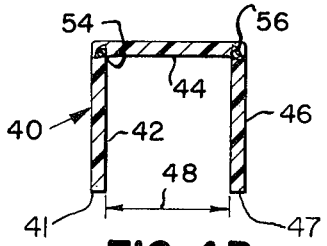
FIG. 4B is the element shown at FIG. 4A, except as it appears when further worked to provide certain structural features of my invention.

A further important detail of channel 40 is seen by particular attention to FIGS. 3, 4A and 4B. There I show a pair of grooves 54, 56 formed and spaced apart by an interval designed to give good electrical separation for and minimize light interference by conductor means 58, 60 which are carried in said grooves formed to receive the conductors. In this manner the necessary function of carrying electrical current from the base of the fixture to the top light socket through an essentially transparent and/or translucent support structure is achieved. The grooves themselves are parallel to each other, and to the longitudinal axis of channel 40. Additionally, grooves 54, 56 (and conductors 58, 60 carried thereby) are positioned relatively close to the elongate light tube to substantially reduce shadow casting by the conductors on the inner surface of outer light dispersing fixture 30.

By providing a structurally reliable inner supporting member 32 I am able to achieve another feature of my invention, and that is to provide a means to cooperatively receive and carry an outer light dispersing fixture 30 which may comprise a light diffuser and, in the case of certain outdoor fixtures, may be combined with an ornamental or protective cage. Fixture 30 is preferably positioned far enough away from the elongate light tube that any shadows cast by the inner structures are unnoticable on the surface of the fixture. This positioning, together with the light dispersing properties of fixture 30, substantially eliminate for the viewer any variations in light intensity originating radially inwardly of fixture 30. Inner supporting member 32 may be utilized to carry plate member 50 which in the embodiment shown in FIGS. 1 and 2 acts as an upper positioning and spacer device to snugly hold fixture 30 circumjacent to member 32. The lower end of fixture 30 is carried by flange 28 whose upright lip portion cooperatively fits thereabout. Cover means such as cap 62 is provided to fit over the upper end of fixture 30 and protect the upper socket assembly.

Thus it may be appreciated that the basic structure I have just described achieves the objective of my invention to provide an essentially light-obstructing free, light dispersing structure which enhances illumination from an elongate light tube uniformly through an entire 360° arc thereabout.

At FIG. 4A I illustrate a preferred method of fabricating channel member 40 of one embodiment of my invention. There I show sheet 40*a* selected from one of the group of materials enumerated hereinabove (translucent or transparent plastic or glass or ceramic material). The sheet is cut to a predetermined width and length with wall portions 42*a*, 44*a*, and 46*a* so that upon finish the U-shaped channel formed (FIG. 4B) shall have the desired wall and opening dimensions. Grooves 54*a* and 56*a* are formed on one side of the wall, preferably with a groove wider at the bottom thereof than at entry, dimensioned to receive therein conductors 58, 60. The conductors are next placed, and then the plastic material is treated so that the sheet may be conveniently formed to the configuration of FIG. 4B, with the conductors now permanently and safely encapsulated at the inside corners of the channel.

One specific example of the fabrication of this portion of one embodiment of a device embodying my invention is as follows:

A flat sheet of clear poly (methyl methacrylate) of 3/16 inch thickness and 24 inches long by 6 inches wide is routed with two parallel grooves of approximately 3/32 inch depth and similar width, parallel to the long edges and about 2 inches from each side. Preferably the cutting tool should rout channels wider at the point of maximum depth than at the surface of the plastic.

A bare 18 gauge copper wire (another electrically conductive material of perhaps different size would also be suitable) of about 30 inch length is laid in each channel projecting equally at either end. The flat sheet is then heated and bent along the grooves and around the wires to 90° angles. A channel 24 inches long by about two inches on each of its edges is thereby formed, with conductors embedded along the length within the corner bends. Preferably the grooved plastic sheet is heated selectively along the grooves before insertion of the wires, and the latter mounted in a jig under tension for ease of assembly. Embedding the necessary electrical conductors is accomplished simultaneously with forming of the channel. Heating of the plastic to permit forming may be accomplished in any of a number of ways readily apparent to those skilled in the art. The channel so formed is not necessarily limited to 90° corner angles. Further, I have found it advantageous, although not essential, to affix an end plate to either end or to both ends of the channel. This improves structural rigidity and provides other mechanical and design advantages.

Though I have detailed a specific example of fabricating an internal holder for an elongate light tube source in an improved lighting fixture, I point out that one objective of this invention is to provide a commercially practicable means for fabricating such a tube holder. It will be apparent to one skilled in the art, that construction materials may be fabricated by many methods, including techniques of blowing, casting, molding, extruding, laminating, vacuum forming, etc. On a large scale of manufacture one of these alternative procedures, or a combination of one or more, might be advantageously employed. Furthermore, some combination of plastic with another material (e.g., dye, pigment, stabilizer, filler or reinforcing aid) might also prove desirable.

A notable feature of my invention is the achievement of an aesthetically pleasing appearance to the assembled fixture as diagrammed in FIG. 1. This requires a uniformly lighted appearance from any angle of viewing from a circle surrounding the longitudinal axis of the lamp. The accomplishment of this objective is related to a number of factors including dimensions of the components and their relative positioning, the refractive indices and light scattering characteristics of the materials, and the size of light source. Without the proper combination of these factors, it is possible to "project" images of the encapsulated conductors 58 and 60 as undesirable shadows on the surface of outer light dispersing fixture 30. Also, when inner supporting member 32 is of the channel type of configuration, edges 41 and 47 (FIG. 4B) may similarly project shadows.

In the construction example heretofore cited and wherein member 32 is fabricated from clear acrylic plastic of the indicated dimensions with outer light dispersing fixture 30 of about 6 inches diameter and the fluorescent tube a standard commercially available item of approximately 1½ inches diameter, the appearance of the lighted outer fixture will be essentially free from shadows. However, in scaling the entire structure to the use of tubular light sources of smaller dimensions, it may be structurally unsound to reduce dimension 48 of inner supporting member 32. As a consequence and because a smaller diameter tubular light source is employed, objectionable shadows may be projected on the surface of fixture 30. These shadows may be eliminated by a variety of approaches.

One simple expedient is to fabricate inner supporting member 32 from slightly translucent rather than completely transparent material. The resultant light scattering will generally eliminate the projected shadows from outer light dispersing fixture 30 depending upon the specific identity of construction materials and spatial relationships of the components. However, when employing the channel type of construction for member 32, care must be taken that the pigmentation which effects the translucency not be so dense as to cause a differing brightness to one side of fixture 30 as a result of the comparatively unobstructed passage of light from the tubular source through opening 48 to the fixture. Additionally, when member 32 is of the channel configuration, and if shadows or variations in light intensity from edges 41 and 47 appear on fixtures 30, these can also generally be eliminated by beveling or rounding the edges in question and/or polishing said edges.

Figure 7:
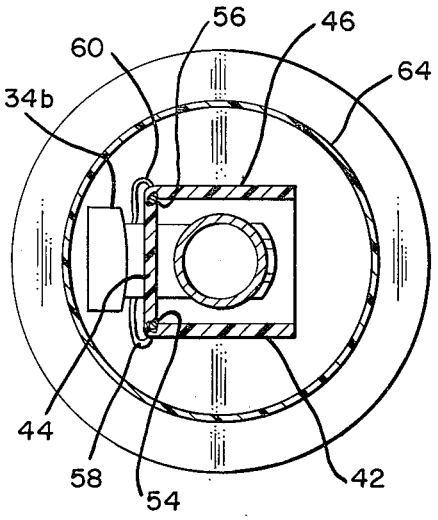
FIG. 7 is a sectional view similar to that of FIG. 3 showing the auxiliary light dispersing fixture in an alternative position.

Another solution to the problem of shadows or variations in light intensity projected on the surface of outer light dispersing fixture 30 is to utilize auxiliary light dispersing fixture 64 shown in FIG. 7 and in phantom in FIG. 3. (The inclusion of fixture 64 in the embodiment exemplified by FIG. 3 is alternative, and hence fixture 64 is shown in phantom lines.) The use of such an auxiliary light dispersing fixture will eliminate variations in light intensity projected to the surface of fixture 30 in any practical dimensioning of a lighting structure constructed according to the present invention, even when inner supporting member 32 is fabricated from a completely transparent material.

Again with reference to FIG. 3 auxiliary light dispersing fixture 64 is there shown positioned in one of its applications. Auxiliary fixture 64 is preferably a translucent material surrounding the tubular light source. It is preferably of tubular configuration and of maximum diameter as may be accommodated by the inner dimensions of inner supporting member 32. Auxiliary light dispersing fixture 64 may be formed of a variety of translucent materials including lightly pigmented translucent plastics, translucent glass, parchment or onionskin papers, or other similar substances. It will, of course, be formed to permit access to the light source tube as needed for cleaning or replacement. For instance, auxiliary fixture 64 might be formed as a polystyrene tube split longitudinally to provide such access.

Alternatively, with reference to FIG. 7, auxiliary light dispersing may be positioned between member 32 and outer light dispersing fixture 30, thus enveloping the entire inner supporting structure with the light diffusing material. In this case auxiliary fixture 64 can take the form of a cylindrical surround; or it may conform to the outer surface of member 32, preferably bridging any openings such as 48, 148, or 248 in the drawings. The ultimate effect served by the placement of auxiliary fixture 64 in this fashion is the same as the placement shown in FIG. 3, i.e., the elimination of variations in light intensity which might otherwise be projected on the surface of outer light dispersing fixture 30.

Figure 5:
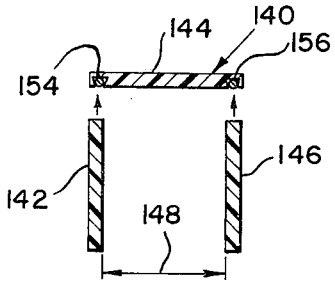
FIG. 5 is an alternative embodiment of that portion of my invention illustrated by FIGS. 4A and 4B.
Figure 6:
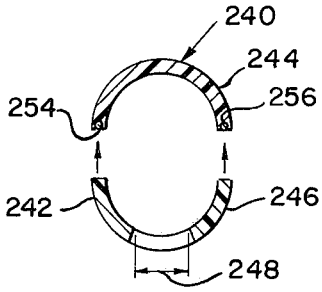
FIG. 6 is still another alternative embodiment of that portion of my invention exemplified by FIGS. 4A and 4B.

Alternative embodiments of channel member 40 of my invention are illustrated at FIGS. 5 and 6, wherein the reference numerals are distinguished from those of the embodiment illustrated at FIGS. 1, 2, 3 and 4B by merely suffixing the latter by 100 (FIG. 5) or 200 (FIG. 6). The similiar numeral designations, however, correspond to those of the same significant digits in FIGS. 1, 2, 3 and 4B; and the same explanation set forth in the specification herein above with respect to those Figures are similarly applicable to the corresponding elements of FIGS. 5 and 6. Repetition would appear to be unnecessary, redundant, and would not add to an understanding of the invention herein which is now believed to be complete within the proscription of the foregoing specification.

However, it should be noted in particular that insertion and removal of the light tube could alternatively be accomplished by use of a removable end piece from inner supporting member 32 with the elimination of opening 248 from FIG. 6. Preferably member 32 is of tubular configuration in this alternative arrangement. I have also found it feasible to employ an end plate with "bayonet" mounting and having suitably engaging electrical contacts. Further details related to the interlocking end piece to provide mechanical and electrical connection are known to those of ordinary skill in the art and thus are not further set down in this specification nor the accompanying drawing. It is appreciated, however, that my invention is directed to an improved light dispersing structure including inner supporting member 32 for holding a lighting tube and carrying the necessary electrical conductor embedded in such fashion as to permit full and uniform 360° radiation of light outward from the tube.

Finally, it should be noted that outer light dispersing fixture 30 may be embellished for aesthetic appeal with a carved or etched surface effect in a wide variety of patterns and in differing colors if so desired, or with the addition of a surrounding member fabricated from such materials as expanded or perforated metals, or with decorative grills made of wood, hardboards or varying synthetics.

I claim:

1. In an electric light fixture of the type employing a lamp base to house the ancillary circuitry and support an elongate light source tube, an improved light diffusing structure therefor to enhance shadow-free 360° illumination about the longitudinal axis of the light source tube comprising:

an inner supporting member at least partly surrounding said light tube, said member fabricated of a relatively thin, light transmitting sheet material and having walls substantially free of any light obstructing material, said member shaped to removably receive through an opening thereof an elongate light source tube and adapted to carry at each end of said supporting member a connection for physical and electrical securement of the elongate light source tube, said supporting member formed to have one end thereof attached to said lamp base, said supporting member formed with a pair of spaced apart grooves parallel to each other and to the longitudinal axis of said tube;

bare wire conductors carried by said supporting member with each of said conductors disposed in a different one of said grooves to convey electrical energy from said ancillary circuitry to the connection for electrical securement of said tube at the end of said member farthermost removed from the base when placed in operative position, said conductors being positioned relatively close to said light tube to substantially reduce the shadow-casting properties of said conductors, and an outer light diffusing member circumjacent to said member, said diffusing member being positioned away from said supporting member to substantially eliminate variations in light intensity originating radially inwardly of said diffusing member.

2. The improved light fixture as defined in claim 1 wherein said supporting member is formed to have the opening therethrough along one longitudinal side thereof.

3. The improved light fixture as defined in claim 1 wherein said supporting member is formed to define walls circumjacent said light source tube, and wherein the opening to receive said tube therethrough is defined by an opening located at one end thereof, and removable cover means for attachment to said one end to provide physical and electrical securement of the elongate light tube source.

4. The improved light fixture in accordance with claim 1 and wherein said supporting member in cross-section is a channel of U-shape.

5. The improved light fixture as defined in claim 4 and wherein further the longitudinal edges of said channel are formed to substantially eliminate variations in light intensity emanating from said edges.

6. The improved light fixture in accordance with claim 1 wherein said supporting member in cross-section is of tubular configuration.

7. The improved light fixture as defined in claim 1 and wherein further at least one plate member is secured to said inner supporting member at one of the ends thereof, said plate member being shaped to snugly receive and hold said outer light dispersing member.

8. The improved light fixture as defined in claim 1 and wherein further an auxiliary light dispersing member is positioned between said supporting member and said outer light dispersing member, said auxiliary member formed to at least partially envelope said supporting member.

* * * * *